United States Patent [19]

Foults

[11] 4,019,666

[45] Apr. 26, 1977

[54] FASTENER ATTACHING MACHINE HAVING MEANS FOR ORIENTING CAPS, BUTTONS, AND THE LIKE

[75] Inventor: Jonathan Asa Foults, Wolcott, Conn.

[73] Assignee: Scovill Manufacturing Company, Waterbury, Conn.

[22] Filed: Nov. 10, 1975

[21] Appl. No.: 630,449

[52] U.S. Cl. ..... 227/119

[51] Int. Cl.[2] ..... A41H 37/10

[58] Field of Search ..... 227/117, 118, 119, 155

[56] References Cited

UNITED STATES PATENTS

| | | | |
|---|---|---|---|
| 2,136,536 | 11/1938 | Bares | 227/117 |
| 2,588,486 | 3/1952 | Clarke | 227/119 |
| 2,856,606 | 10/1958 | Richards | 227/117 |
| 3,815,805 | 6/1974 | Beneteau | 227/119 |

*Primary Examiner*—Granville Y. Custer, Jr.
*Attorney, Agent, or Firm*—Dallett Hoopes

[57] ABSTRACT

Button, cap, or the like is oriented as it is rolled along trough contacting a friction surface and then is placed directly into a setting die. Prior to the setting operation, the die is shifted in a rotary movement to a selected position to reorient the button depending on the heading which it should have on the garment.

9 Claims, 18 Drawing Figures

FASTENER ATTACHING MACHINE HAVING MEANS FOR ORIENTING CAPS, BUTTONS, AND THE LIKE

BACKGROUND OF THE INVENTION

1. Field of the Invention

This invention relates to fastener attaching machines adapted to attach buttons or snap fastener parts to fabric of a garment, for instance. More specifically, the invention relates to the provision in such a machine of means for orienting the button, cap, or the like so that the inscription or marking on buttons or caps on a garment is oriented in the same direction, i.e., right side up.

2. Description of the Prior Art

A fastener attaching machine comparable to the basic machine with which the present invention may be used is shown in the U.S. Pat. No. 2,735,567 which was granted Feb. 21, 1956 to Carpinella. The machine shown in this patent, while meritorious, does not provide means for registering caps according to the direction in which the legend on the caps face. Orienting means for such a machine are, however, shown in the two Troske U.S. Pat. Nos. 2,595,206 and 2,878,954, issued Apr. 29, 1952 and Mar. 24, 1959 respectively. In each of these latter patents, wheel means are provided for spinning the cap or button as it is pushed along its slide bracket toward the jaw and finger means on the pusher retain the cap or button in proper orientation when it is finally turned to face in the proper direction by the wheel. U.S. Pat. No. 3,815,805, granted June 11, 1974 to Beneteau, discloses means for rolling a button into oriented position.

The afore-mentioned patents, however, are not concerned with the idea of re-orienting the button once it is placed in the jaw of the setting machine. Such re-orientation is desirable, of course, in cases in which the cap or button is oriented in different directions with respect to the various working edges of the garment. The buttons or caps with which the present attaching machine may be used may be formed with two or more prongs to be clinched into a backing member or snap fastener socket on the other side of the garment fabric. Alternatively, the button, for instance, may be formed with a barrel into which a conventional fastening tack is driven in attachment. It is the attachment of the button to the tack or backing element and the attachment of the cap to the backing element with which the present invention is concerned.

SUMMARY OF THE INVENTION

The invention therefore involves the provision of means for orienting the cap or button and placing it in the setting die, and means for then re-orienting or re-registering the cap or button to face a selected direction after it has been re-oriented.

BRIEF DESCRIPTION OF THE DRAWINGS

Other features and objects of the invention will be apparent to those skilled in the art from a study of the following specification including the drawings, all of which disclose a preferred, non-limiting embodiment of the invention. In the drawings.

DESCRIPTION OF THE PREFERRED EMBODIMENT

Figure 1:
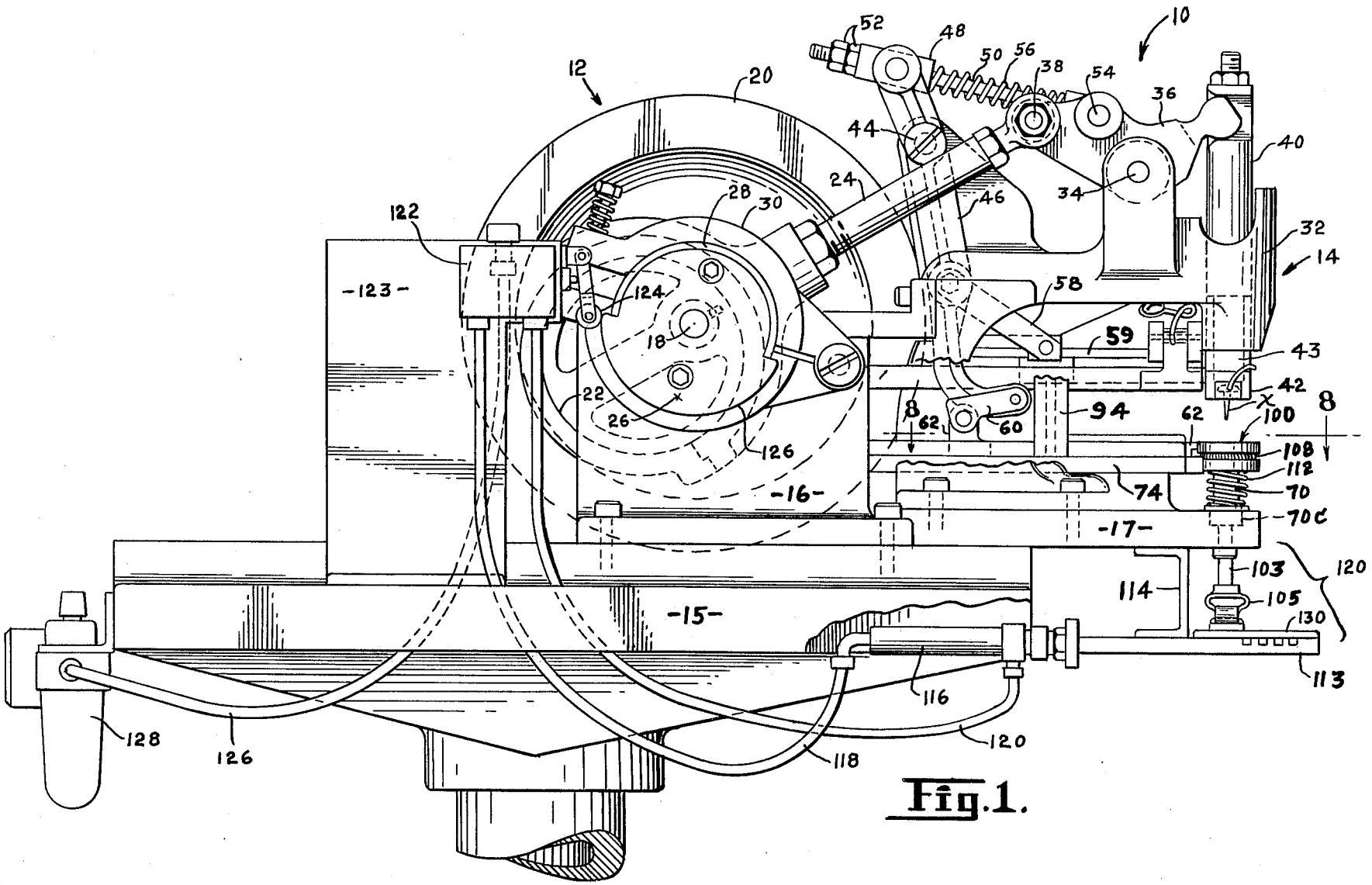
FIG. 1 is an elevational view with portions broken away of a complete fastener attaching machine embodying the invention.

A machine embodying the invention is generally designated 10 in FIG. 1. It comprises a drive section 12 and a setting section 14. The machine is substantially as disclosed in the abovementioned U.S. Pat. No. 2,735,567 to Carpinella. For convenience, however, its structure will be briefly detailed herein, although it should be understood that the description of structure and operation of the Carpinella machine should be hereinto incorporated by reference.

DRIVE MEANS

The driving section comprises a support platform 15 on which is mounted a bearing block 16 which journals a drive shaft 18 driven by a belt (not shown) engaging the flywheel 20 fixedly mounted on one end of the shaft 18. An eccentric 22 is also mounted on the shaft 18 and drives a pitman link 24. Also mounted on the shaft 18 is a valve-operating cam 26 having therebehind a brake drum 28 which is engaged by the brake 30.

SETTING MEANS

The fastener setting unit 14 comprises a bed plate structure 17 also mounted on platform 15. The structure includes the frame 32 up from the plate 17 and having a horizontal pivot shaft 34 disposed thereon with an oscillateable relatively short crank lever 36 thereon. As shown, the leftward end of the lever 36 is pivotally attached to the pitman link 24 by a pin 38. The opposite end of the lever 36 is shaped to fit into an opening in a plunger 40 on the lower end of which is a tack-carrying receiver 42 and setting punch 43, as is well known in the art.

As disclosed in the Carpinella U.S. Pat. No. 2,735,567, the frame 32 also mounts a fixed pin 44 on which is pivoted the slide-operating lever 46. The upper end of this lever is secured to a bearing block 48 which receives a lost motion rod 50 in slidable relation. The leftward end of the linkage is provided with stop nuts 52 while the opposite end is pivoted as at 54 to the bellcrank lever 36. A spring 56 circumposes the rod 50.

The mid-portion of the operation lever 46 is pivoted, as shown, to an upper element slide link 58 adapted to move tacks (not shown) into the receiver 42 and the lower portion of the lever is connected to link 60 attached to a pusher 62 to be described in detail below.

A rotary die 70 is mounted on the bearing plate 17 and receives the lower fastening elements as they are delivered by the pusher 62.

In operation, with the wheel 20 on shaft 18 rotating, and upper and lower elements being properly placed in the receiver 42 and the gripping head 100, respectively, and with the garment in between, the bellcrank 36 drives the plunger 40 downward to set the fastener in the garment. This is all as substantially described in the Carpinella U.S. Pat. No. 2,735,567, with the exception that in the present setting machine, the cap or button element is the lower element and the tack or other cooperant element is the upper element.

ORIENTING MEANS

Referring more in detail to the slide bracket and pusher element and head of the machine, reference will now be made to FIG. 3. The slide bracket in which the pusher 62 operates comprises a base element 74 on plate 17 and having a pair of overhanging angles **76*a* and 76*b*. These angles are similar and confront each other so that an enlarged recess 78 is provided along the base 74 and inwardly extending flanges 76*c* and 76*d* present a narrowing throat 80 to the recess 78**.

The angles **76*a* and 76*b* are both secured to the base 74 as shown. However, one of the angles, 76*b*, is provided in its undersurface with a recess in which is disposed the friction plate 82 which rests down against the base 74. The plate is held downward by angle 76*b* which in turn is held downward by springs 84 disposed respectively between the heads of those bolts and the angle 76*b*. The plate 82 is amply apertured about bolts 87. Horizontal bolts 88 engage tapped openings in base 74. Springs 82*a* circumposing the bolts 88 respectively urge the plate 82** inward.

As shown, the inner end of the friction plate 82 is bevelled off to present a knurled downwardly inclined face 90 for reasons which will appear.

As described, the pusher 62 reciprocates in the longitudinal recess 78 and is supported laterally by a pair of guide strips 92. As shown, a track 94 is used to deliver lower elements to the recess 78 in one-by-one fashion as the pusher 62 clears the opening of the lower element passageway 96 to the recess 78.

Similar track and pusher elements are provided for the upper element means as is well-known in the art, the upper element being moved toward the receiver 42 by upper pusher 59 in proper timed relation driven by the link 58.

As best shown in FIG. **4*a*, a button B which has been delivered face down from the track 94 through passage 96 is engaged by the pusher 62 and is moved leftwardly, as shown. The pusher 62 consists of a pair of side-by-side rods 62*a* having forward noses 62*b* (FIG. 7**) which are preferably contoured to engage the hub H of the button B. The cap or metal face of the button B is crimped about the periphery thereof as at R and presents an inward tab T for purposes of orientation.

Completing the pusher and disposed between the rods **62*a* is a finger 62*c*. The finger is pivoted to the two rods as at 62*d* (FIG. 2) and spring-pressed as at 62*e* so that its lead end is urged downwardly. The lower end of the finger 62*c* (FIG. 7) is formed with a pair of spaced downward latches 62*f* and 62*g*** which are preferably separated by a space which is the approximate width of the tab T.

Figures 2, 3, 4A, 4B, 5A, 5B, 6A, 6B, 6C, 7:
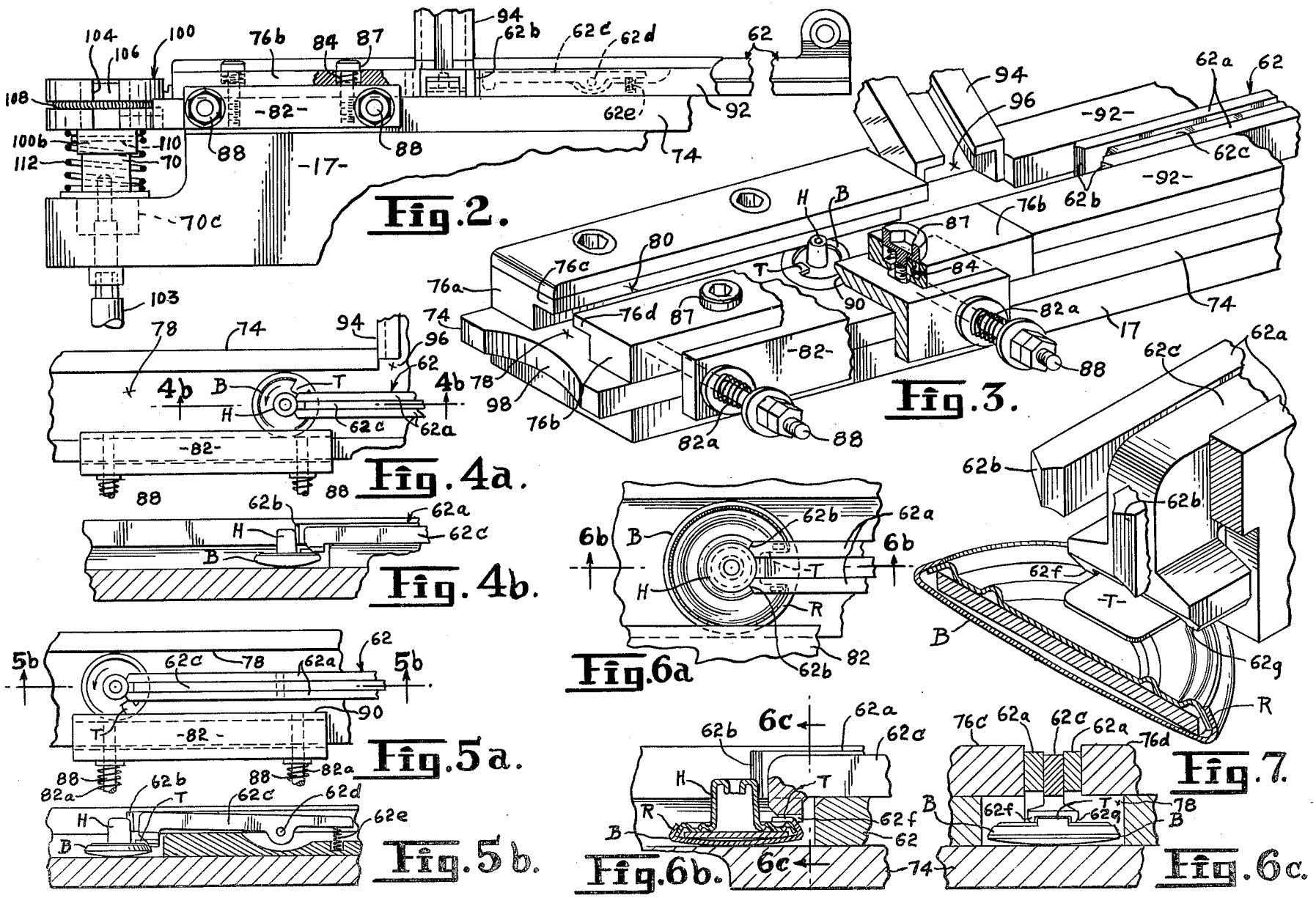
FIG. 2 is an enlarged fragmentary view taken from the opposite side of the machine of FIG. 1 showing the gripping head, die or post, and re-orienting device, in part.
FIG. 3 is a perspective view of a slide bracket embodying the invention.
FIG. 4*a* is a top view showing a button being pushed along the slide bracket of a machine embodying the invention.
FIG. 4*b* is a view taken along the section line 4*b*—4*b* of FIG. 4*a;*
FIG. 5*a* is a view showing a button having been pushed sufficiently far so that the tab-retaining finger on the pusher has engaged a tab on the button.
FIG. 5*b* is a sectional view taken along line 5*b*—5*b* of FIG. 5*a;*
FIG. 6*a* is an enlarged plan view showing a pusher in an embodiment of the invention engaging a button with the finger of the pusher engaging the tab of the button so that the button stays in oriented disposition.
FIG. 6*b* is a sectional view on the line 6*b*—6*b* of FIG. 6*a;*
FIG. 6*c* is a cross sectional view taken on the line 6*c*—6*c* of FIG. 6*b;*
FIG. 7 is a greatly enlarged fragmentary perspective view showing a fragment of a button being engaged in the tab-retaining disposition of the pusher finger.

As shown in FIG. **5*a*, after the pusher 62 has moved the button B along recess 78, the frictional engagement of the rim R of the button with the underside of the bevelled knurled surface 90 has caused the counterclockwise rotation, as shown in FIGS. 4*a* and 5*a*, of the entire button. This rotation continues until, as shown best in FIG. 7, the tab T locates itself between the latches 62*f* and 62*g*. For the rest of its longitudinal journey along the path 78, the button is thereafter held from rotation by the finger 62*c*, the holding of the latches 62*f* and 62*g* being sufficient to overcome any tendency of the button to turn further on account of its engagement with the knurled surface 90**.

As shown in FIG. 3, the front end of the base 74 is formed with an arcuate cut-out 98. This cut-out conforms to the cylindrical shape of the gripping head 100 (FIG. 2).

Figures 8, 9, 10, 11, 12, 13, 14:
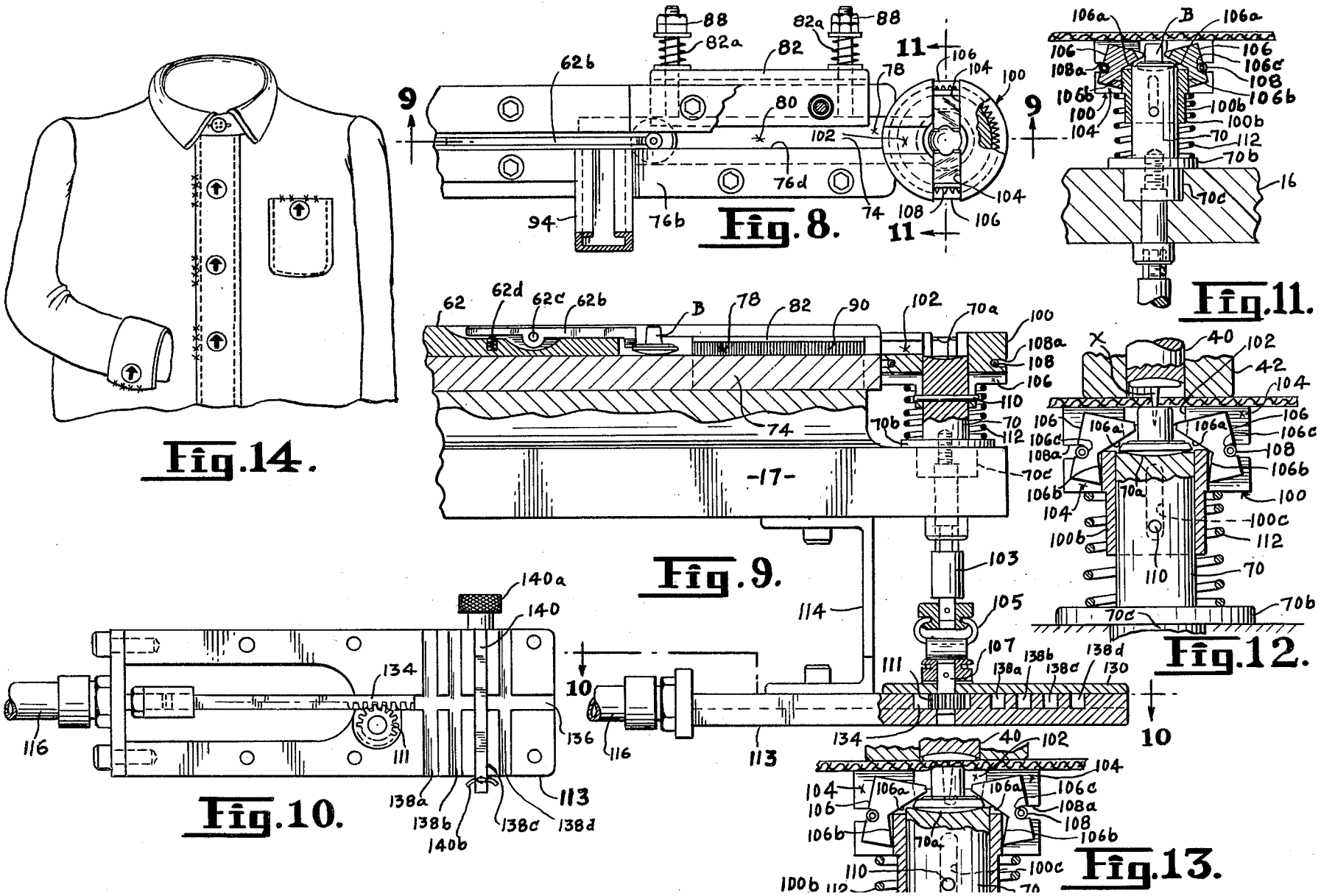
FIG. 8 is a sectional, slightly enlarged, view taken on the line 8—8 of FIG. 1.
FIG. 9 is an enlarged and partly broken away side view of the slide bracket, gripping head, stationary die, and re-orienting means of the machine of FIG. 1.
FIG. 10 is a plan view taken on the line 10—10 of FIG. 9.
FIG. 11 is a sectional view of the gripping head and post showing cloth and button in position.
FIG. 12 is a similar view enlarged showing the tack receiver and gripping head clamping the cloth therebetween.
FIG. 13 is a view showing the position of the units at the completion of the tack-setting operation.
FIG. 14 is a view showing a shirt illustratively demonstrating the need for selective re-orientation of buttons as accomplished by the present invention, the orientation of the various buttons marked with an arrow and the working edges of the adjacent material marked with X's.

As will be noted from FIGS. 8 and 9, the gripping head 100 is essentially cylindrical. Its top is formed with a radical recess 102 which is undercut to receive the button B as the button is moved by the pusher to the concave die or post top **70*a*. The bottom of the recess 102 is substantially at the level of the bottom of recess 70*a*** so as to provide a smooth travel for the button.

A pair of diametrically opposite radial notches 104 are formed top to bottom in the cylindrical head 100 at 90° with respect to the recess 102. The notches loosely receive gripping latches 106 which have inward button-engaging projections at the upper ends thereof. The undersides **106*a* of the projections which actually engage the button B as shown (FIG. 11**) also comprise camming surfaces as will be explained.

The lower portions of the latches are formed with angular flat shoulders **106*b* and the rearward face of each of the fingers is horizontally notched as at 106*c* to receive a garter spring 108 riding in a circumferential groove 108*a* about the gripping head. The garter spring 108 urges the latches 106 inward. The head has a central downward bushing 100*b* which is vertically slotted as at 100*c* at diametrically opposite portions and the slot receives a pin 110 which extends through the post or die 70. The ends of the slot 100***c* form the stops for the travel of the head, and the pin keys the head 100 for rotation with the post 70 for reasons which will be explained. The head is biased upwardly in the position shown by the spring 112. As shown, the die 70 carries an outward flange 70*b* on which spring 112 rests and a downward boss 70*c* which is rotatably received into a well in the bed plate 17.

The setting operation will now be clearly understood. With a button or the like disposed at the upper end of the post 70 held down by the latches 106 of the gripping head 100 and with the garment material resting on top of the head 100, the plunger 40 is driven downward, the receiver 42 carrying a downwardly directed tack or other fastener element X properly aligned with the central portion of the hub of the button. The element X first pierces the garment (FIG. 12) then enters the hub and is clenched inside the button B (FIG. 13) securing the button to the garment. As the plunger 40 comes all the way down, it presses downwardly on the head 100 so that the head rides down on post 70, the camming surfaces 106*a* engage the upper edges of the post 70 and open to permit the upward movement and escape of the button B as the garment is moved away. Subsequently, the machine moves towards another cycle with the receiver 42 raising and the head 100 returning to position shown in FIG. 11. Simultaneously, pushers 59 and 62 retract. Subsequently, the pushers drive new elements respectively into the receiver 42 and gripping head 100. As the pusher 62 moves forward, the button or other lower fastener element moves smoothly from the recess 78 into the gripping head via radial recess 102 and under the latches 106 as shown in FIG. 11.

Thus far has been described a machine adapted to set oriented fasteners so that with respect to the machine each fastener will have the inscription on its face oriented in the same way. This is due to the described cooperation of the finger 62*c* with the tab T on the button B. It should be understood that the tab could be replaced by appropriate indentations on the button B which could engage structure similar to latches 62*f* and 62*g*.

RE-ORIENTING MEANS

Means for re-orienting the button or other lower fastener element will now be described.

Referring to FIG. 14, the need for such orientation will be understood. Obviously, the orientation of the inscription on the button in the finished garment will depend on the orientation of the button with respect to the adjacent edge which is inserted into the machine in attaching the fastener. For instance, with the adjacent edges or working edges marked X's in FIG. 14, it will be seen that for the pocket, the arrow, for instance, should point toward the working edge. For the cuff, the arrow should point away from the working edge, and for the shirt front placket should point sidewise with respect to the working edge. This will enable all arrows to point upwardly on the finished garment, the ultimate objective in the fastener setting operation. The working edge of the garment with respect to FIG. 1 will be that edge which is placed into the machine between the receiver 42 and the gripping head 100 and which bears a perpendicular relationship to the sheet of drawings.

Apparatus for re-orienting the lower fastener element is generally designated 120 on the drawings (FIG. 1). Referring now to FIG. 9, a bore through the bed plate 17 permits passage of the die rotating shaft 103 which is joined to and connects downward from the boss 70*c*. The shaft terminates downwardly in a coupling element 105, the lower end of which is connected to a stub shaft 107 fixedly mounting a pinion 111. The pinion and stub shaft are journaled for rotation in a housing 113 secured by a bracket 114 below the bed plate 17.

The housing 113 has a cover plate 130 (FIG. 9) which is apertured to form an upper journal for the stub shaft 107. The piston drive shaft 132 extends leftwardly and terminates in a gear rack 134 which meshes with pinion 111.

Mounted on the leftward end of the housing (FIG. 1) is a piston cylinder 116 which is connected through inlet and exhaust hoses 118 and 120 respectively to a control valve 122 carried by frame 123 extending upward from the support platform 15. The control valve 122 is operated by a cam follower 124 which engages the cam 26 as the drive shaft 18 for the setting machine rotates. An air supply 126 is connected through filter 128 to an appropriate source (not shown).

The housing 113 is formed with a longitudinal passage 136 for guiding the rack 134 as it reciprocates. Extending laterally from the guideway 136 are stop channels 138*a*, 138*b*, 138*c*, 138*d* (FIG. 10) into one of which is selectively disposed a suitable bar 140 having a handle 140*a* at one end and a retaining clip 140*b* at the other. The portion of the stop bar 140 disposed in the passage 136 forms a stop for the end of the rack 134 as it is reciprocated rightwardly and, through the pressure to drive the piston and rack 134 is present in the cylinder 116, the stop bar 140 terminates the travel of the piston and rack thereby limiting the extent of rotation of the pinion 111.

As a result of the rack and pinion arrangement, when the piston in cylinder 116 is activated after the cap has been placed in the head 100 by the pusher 62, the pinion 111 and consequently shaft 107, coupling 105, shaft 103, die 70, and head 100 are rotated, re-orienting the cap or button disposed on the concave face 70*a* of the die. The rotary extent of re-orientation depends, of course, on the length of travel of the rack 134 which in turn is controlled by the position of the stop bar 140. It is highly desirable that the increments between the stop channels 138*a*, 138*b*, etc. be such that the corresponding motion of the rack in traveling from one stopped position to the next, have a 90° rotary effect on the pinion 111 and die 70. In practical consequence, referring to the garment in FIG. 14, the button for the pocket may be re-oriented correctly when the stop bar is in channel 138*a*, for the shirt placket when the stop bar is in passage 138*b*, and for the sleeve when the stop bar is in channel 138*c*.

It will be understood, of course, that the facing surface of the garment will be faced downwardly to have the cap or button attached to it during the setting process. Obviously, intermediate stopping arrangements for the rack 134 can be made to effect any suitable or desired orientation of the button or cap. For most garment operations, however 90° increments in the turning of the cap have been found sufficient.

It will be apparent that there are many advantages in the apparatus described. The simplicity of operation which involves the direct placement of the button into the die from the orienting track 78 will be apparent. Additionally, the foolproof method of re-orienting the cap depending on the position in which the cap or button is to be placed on the garment will be readily appreciated.

It is also apparent that there may be many variations of the invention. For instance, rather than the latches 106, the cap or button, if made of ferrous-containing material, may be held on the top of the die 70*a* simply by having the upper portion of permanently magnetized material.

It is thus desired that the patent protection afforded herein shall cover all such variations, all falling within the following claim language or equivalents thereof.

I claim:

1. In an attaching machine for fastener elements each having a depression offset from its center, the machine having a vertically fixed die surrounded by a vertically movable element-receiving gripping head and a movable setting plunger adapted to cooperate with the die, a horizontally disposed slide bracket directed at said head and a pusher for moving the element along the slide bracket to the head, said bracket having means for rotating the element, the pusher having a depression-engaging finger adapted to hold the element from rotating and hold the rotary orientation of the element once the orientation is in a predetermined direction as the element moves along the slide bracket; the improvement including means to rotate the die and head about a vertical axis to re-orient the fastener element to the desired extent prior to the descent of the setting plunger toward the die.

2. The improvement as claimed in claim 1 wherein the means to rotate the die and head includes a rack driven by linear drive means and a pinion engaging the rack, the pinion operatively associated with the head so that as the pinion is rotated by the rack, the head, holding the element, is rotated by the pinion.

3. The improvement as claimed in claim 2 wherein adjustment means are provided to limit the rotation of the die and head to a selected extent so that appropriate orientation of the element may be effected for a given operation, the last-named means being adjustable stop means selectively limiting the linear outward travel of the rack.

4. The improvement as claimed in claim 1 wherein said means to rotate the die and head includes means to limit the rotation of the die and head to a selected degree so that the appropriate orientation of the element may be effected for a given operation.

5. For an attaching machine having an attaching post and cooperant die adapted to attach fastener elements such as buttons and snap fasteners to fabric, a re-orienting means adapted to impart a rotary shift to the fastener element supported on the post, the re-orienting means comprising gear means coaxial with the attaching post and means rotatably linking the fastener element and the gear means and a gear rack engaging the gear means, linear movement means for the gear rack and adjustable stop means limiting the travel of the gear rack so that the movement of the rack, driven by the linear movement means, will be terminated outwardly at a selected point thereby limiting the rotary movement of the fastener element.

6. Re-orientating means as claimed in claim 5 wherein the adjustable stop means comprises a plurality of cross channels in a structure adjacent the gear means, the channels being disposed in and transverse to the path of travel of the rack, and a stop element disposed selectively in one of said channels.

7. Re-orienting means as claimed in claim 5 wherein the linear movement means is a pneumatic piston and cylinder.

8. A fastener attaching machine comprising a post and die, the post being rotatable, means for delivering the fastener element to the post in a predetermined orientation, means for holding the fastener element centered on the working end of the post and means for imparting to the post once it has received the fastener element a rotary shift to a selected rotary position, and means for moving the die toward the working end of the post to work the element.

9. An attaching machine as claimed in claim 8 wherein the means for imparting a rotary shift comprises a pinion mounted axially on the post and a rack and linear movement means driving the rack, the rack cooperating with the pinion.

* * * * *

REEXAMINATION CERTIFICATE (281st)

United States Patent [19]

Foults

[11] B1 4,019,666

[45] Certificate Issued Dec. 4, 1984

[54] FASTENER ATTACHING MACHINE HAVING MEANS FOR ORIENTING CAPS, BUTTONS, AND THE LIKE

[75] Inventor: Jonathan A. Foults, Wolcott, Conn.

[73] Assignee: Scovill Manufacturing Company, Waterbury, Conn.

Reexamination Request:
No. 90/000,396, Jun. 6, 1983

Reexamination Certificate for:

| | |
|---|---|
| Patent No.: | **4,019,666** |
| Issued: | **Apr. 26, 1977** |
| Appl. No.: | **630,449** |
| Filed: | **Nov. 10, 1975** |

[51] Int. Cl.[3] ..... A41H 37/10; A41H 37/04

[52] U.S. Cl. ..... 227/119; 29/407; 29/432.1; 29/771; 29/809; 227/18; 227/102

[58] Field of Search ..... 29/407, 432.1, 771, 29/809; 198/394; 227/18, 17, 109, 116, 117, 118, 119; 112/113; 221/71, 173

[56] References Cited

U.S. PATENT DOCUMENTS

| | | | |
|---|---|---|---|
| 2,136,536 | 11/1938 | Bares | 227/117 |
| 2,265,574 | 12/1941 | Peterson | 198/394 |
| 2,588,486 | 3/1952 | Clarke | 227/119 X |
| 2,735,567 | 2/1956 | Carpinella | 227/18 |
| 2,856,606 | 10/1958 | Richards | 227/109 |
| 2,878,954 | 3/1959 | Troske | 227/119 X |
| 3,815,805 | 6/1974 | Benteau | 227/119 |
| 3,992,765 | 11/1976 | Silverbush et al. | 227/119 X |
| 4,007,537 | 2/1977 | Silverbush et al. | 227/119 X |

*Primary Examiner*—Paul A. Bell

[57] ABSTRACT

Button, cap, or the like is oriented as it is rolled along trough contacting a friction surface and then is placed directly into a setting die. Prior to the setting operation, the die is shifted in a rotary movement to a selected position to reorient the button depending on the heading which it should have on the garment.

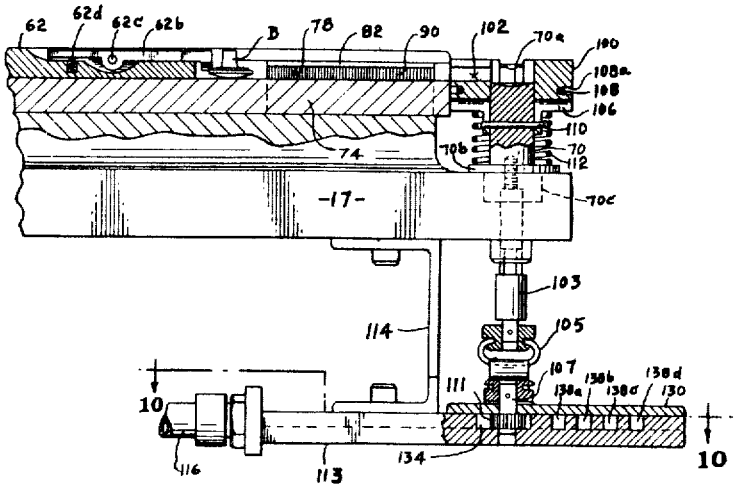

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3, 5, 6 and 7 is confirmed.

Claims 1, 2 and 4 are cancelled.

Claim 8 is determined to be patentable as amended.

Claim 9, dependent on an amended claim, is determined to be patentable.

New claims 10 and 11 are added and determined to be patentable.

8. A fastener attaching machine *for fasteners having indicia-carrying front faces,* comprising a post and [die] *plunger,* the post being rotatable, means for delivering [the] *a* fastener element to the post in a predetermined *rotary* orientation *of the front face of the fastener element,* means for [holding] *firmly retaining* the fastener element centered on the [working end of the] post, [and] *drive* means for imparting to the post once it has received the fastener element a rotary shift to [a selected rotary position,] *reorient the fastener element, settable means for stopping the drive means with the fastener element at the desired re-orientation,* and means for moving the [die] *plunger* toward the [working end of the] post to [work the element] *attach the fastener.*

*10. In an attaching machine for fastener elements each having a depression offset from its center, the machine having a vertically fixed die surrounded by a vertically movable element-receiving gripping head and a movable setting plunger adapted to cooperate with the die, a horizontally disposed slide bracket directed at said head and a pusher for moving the element along the slide bracket to the head, said bracket having means for rotating the element, the pusher having a depression-engaging finger adapted to hold the element from rotating and hold the rotary orientation of the element once the orientation is in a predetermined direction as the element moves along the slide bracket; the improvement including air-driven means to rotate the die and head about a vertical axis to re-orient the fastener element and adjustable stop means associated with the air-driven means to stop the rotation of the die and head at the desired re-orientation prior to the descent of the setting plunger toward the die.*

*11. A fastener attaching machine for fasteners having indicia-carrying front faces, comprising a post and plunger, the post being rotatable, means for delivering a fastener element to the post in a predetermined rotary orientation of the front face of the fastener element, means for holding the fastener element centered on the post, air-driven means for imparting to the post once it has received the fastener element a rotary shift to re-orient the fastener element, adjustable stop means associated with the air-driven means to stop the rotation of the post at the desired re-orientation, and means for moving the plunger toward the post to set the fastener.*

* * * * *